US008087881B1

(12) United States Patent
Cardoso, III et al.

(10) Patent No.: US 8,087,881 B1
(45) Date of Patent: Jan. 3, 2012

(54) DAMPED STATOR ASSEMBLY

(75) Inventors: Louis M Cardoso, III, Palm City, FL (US); Jeffrey M Crutchfield, Jupiter, FL (US); Metthew T Coffin, Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 621 days.

(21) Appl. No.: 12/276,324

(22) Filed: Nov. 22, 2008

(51) Int. Cl.
*F01D 5/26* (2006.01)
*G06F 7/48* (2006.01)

(52) U.S. Cl. ..... 415/119; 703/7

(58) Field of Classification Search ..... 415/119, 415/200; 416/190, 229 A; 703/1–8
See application file for complete search history.

(56) References Cited

U.S. PATENT DOCUMENTS 6,542,859 B1 * 4/2003 Burns et al. ..... 703/7
7,291,946 B2 11/2007 Clouse et al.
7,347,664 B2 * 3/2008 Kayser et al. ..... 415/200

* cited by examiner

*Primary Examiner* — Calvin Lee
(74) *Attorney, Agent, or Firm* — John Ryznic

(57) ABSTRACT

A stator assembly having an inner shroud and an outer shroud with a plurality of airfoils extending between the shrouds, and a vibration damping horn extending from one of the shrouds and aligned with the airfoil, the vibration damping horn having a higher stiffness than the airfoil, and where the vibration damping horn vibrates against a damping spring or within a viscous fluid to dampen the vibration of the stator assembly. The vibration damping horns are thicker than the airfoils to provide for the higher stiffness. The damping spring is enclosed between the shroud and seal to support the spring.

18 Claims, 5 Drawing Sheets

SECTION A-A

Section A-A

DAMPED STATOR ASSEMBLY

FEDERAL RESEARCH STATEMENT

None.

CROSS-REFERENCE TO RELATED APPLICATIONS

None.

BACKGROUND OF THE INVENTION

1. Field of the Invention

The present invention relates generally to a stator assembly for a turbo-machine, and more specifically to a damped stator assembly.

2. Description of the Related Art Including Information Disclosed Under 37 CFR 1.97 and 1.98

An axial flow compressor in a gas turbine engine includes a row of stator vanes upstream and downstream of a row of rotor blades, the stator vanes functioning to guide the air flow into the rotor blades for increasing the efficiency and diffusing the air to increase static pressure. The stator vanes include an arrangement of airfoils that extend between an outer shroud and an inner shroud that defines the flow path through the stator assembly. The stator assembly is also subject to vibrations and thermal stress from high temperature exposure. For these reasons, prior art stator assemblies are formed as segments with one, two, three or more vanes in each segment. Adjacent stator segments are separated by a relief slit to allow for thermal expansion to allow free vibration of the shrouded segments against frictional damper springs, and thus reducing vibratory stresses and extending the life of the part. However, these relief slits allow for leakage of the fluid through the stator assembly. When the segment includes a single vane, then the leakage flow area is larger.

To provide damping to a segmented stator assembly, damper springs are used on the inner shroud area to provide damping. The stator segments are attached to the engine casing at the outer shroud location while the inner shroud is unsupported in the turbo-machine. The stator vanes can vibrate in several different modes. The relief slits separate adjacent segments and prevents the vibratory modes from causing destructive amplification in adjacent vane segments. This amplification can lead to cracking and catastrophic failure of the gas turbine engine if the crack is not detected in time. The prior art U.S. Pat. No. 7,291,946 B2 issued to Clouse et al. on Nov. 6, 2007 and entitled DAMPER FOR STATOR ASSEMBLY discloses a stator assembly with a damper spring positioned between an inner surface of the inner shroud and an outer surface of a seal. The damper spring rubs against the seal surface to dampen the stator assembly. In the Clouse et al. invention, the stator assembly is formed from many segments with many relief slits therein. A relief slit exists for every vane in this design. Therefore, the leakage flow is relatively high.

Another disadvantage of relief slits is caused by the mass of the shroud supported by an individual vane. This mass tends to reduce the resonant frequency modes of a vane compared to a similar vane with no attached shroud. Higher resonant frequencies are desirable, possibly avoidable potential drivers under operational conditions.

Another disadvantage yet is the high cost in fabricating the relief slits. Because the leakage is undesirable, the relief slits are held to a close tolerance fabrication to minimize the leakage area. To form close tolerance relief slits, wire electrodischarge machining (EDM) is used to cut the slits which is both time consuming and expensive. Also, removal of the re-melted material subsequent to the cutting further increases the cost of fabricating the relief cuts. This operation is difficult and is often done manually. Further increasing the cost still yet is the cost involved with inspecting the features which is difficult since the relief slits tend to be very narrow and often at compound angles relative to the full ring.

BRIEF SUMMARY OF THE INVENTION

It is an object of the present invention to provide for a stator assembly with adequate damping and without using relief slits between adjacent airfoils.

It is another object of the present invention to provide for a stator assembly with a lower cost to manufacture.

It is an object of the present invention to provide for a stator assembly with an elimination of costs associated with cutting and inspecting relief slits.

It is an object of the present invention to provide for a stator assembly with increased resonant frequency of individual vanes compared to the prior art.

It is an object of the present invention to provide for a compressor with improved efficiency.

The present invention is a stator assembly for use in a compressor, the stator assembly having an plurality of airfoils extending between an outer shroud and an inner shroud, the stator assembly being formed as large segments to reduce the number of relief slits, the airfoils are cast, brazed or machined integrally into the shrouds, the shroud includes a flexible region around the airfoil such that a relatively low impedance connection is made to a vibration damping horn extending from a thin shroud. The shroud is configured to have a higher stiffness in the forward and aft regions in order to prevent circular distortion of the stator assembly. Also, the shroud may be stiffer between airfoils to further isolate vibratory modes and to further enhance dimensional stability.

The vibration damping horn is cast to or is a continuation of a brazed airfoil. The vibration damping horn is stiffer than the airfoil in order to prevent amplification of the vibration. A damper spring is in contact with the ends of the vibration damping horns to allow for rubbing and produce the damping. The damper spring is coated with a friction coating to minimize spring wear and improve damping properties.

In an additional embodiment, instead of the damper spring to provide damping to the vibration damping horns, a viscous damping fluid or visco-elastic material surrounds the vibration damping horns to absorb the vibration.

In another embodiment of the present invention, the vibrating damping horn can be located on the outer shroud instead of the inner shroud.

DETAILED DESCRIPTION OF THE INVENTION

Figure 1:
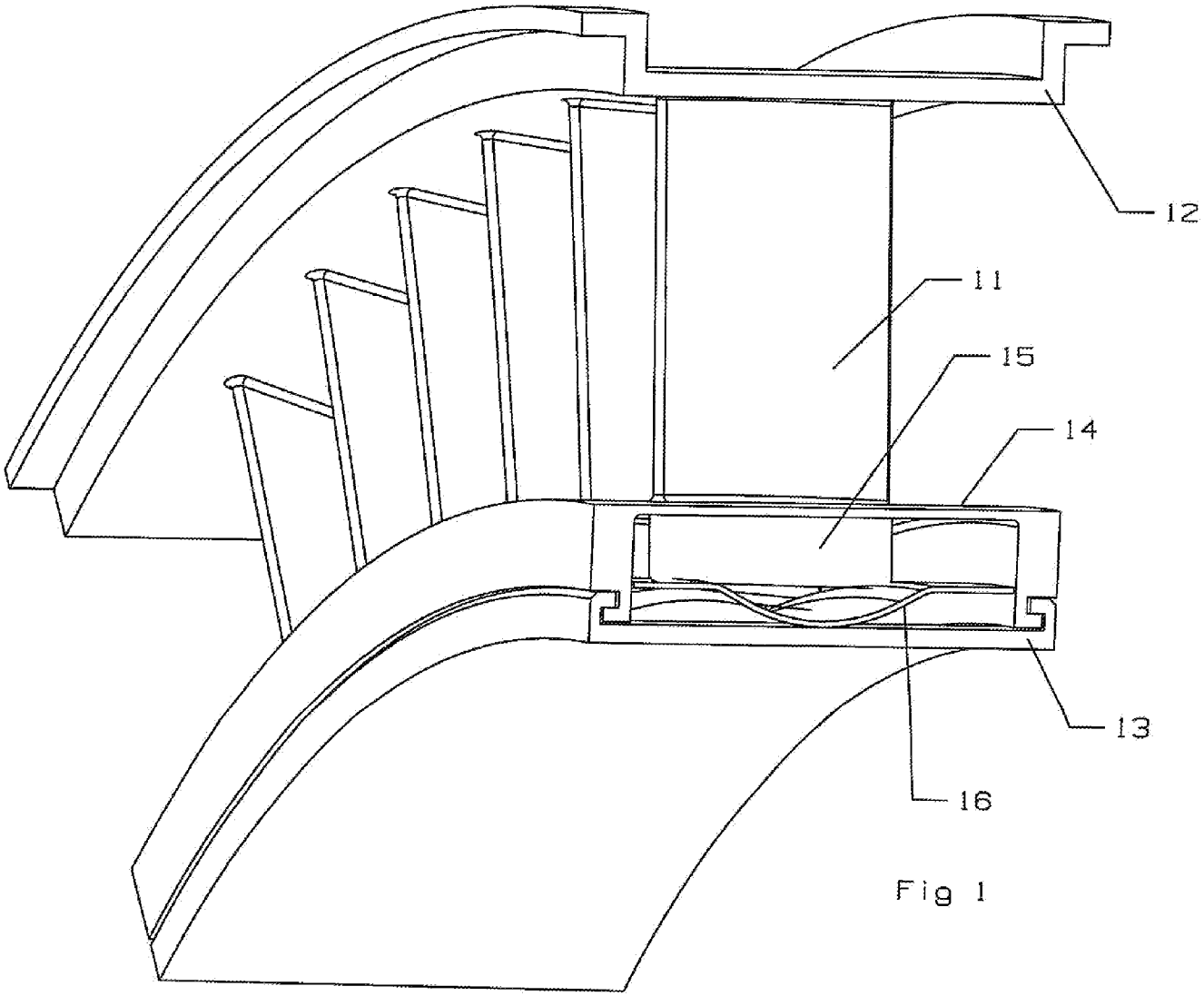
FIG. 1 shows a schematic view of a stator vane segment of the present invention.

A stator assembly segment is shown in FIG. 1 in which a number of airfoils 11 extend between an outer shroud 12 and a thin shroud 14 to form a fluid flow path through the stator assembly. The thin shroud 14 includes legs that extend inward on which a seal 13 is secured, the seal 13 forming an inner shroud for the rotor assembly of the compressor. Extending from the thin shroud 14 is a vibration damping horn 15 that includes an inner end that rubs against a damper spring 16. As seen in FIG. 1, the segment includes a number of airfoils extending between the shrouds.

Figure 2:
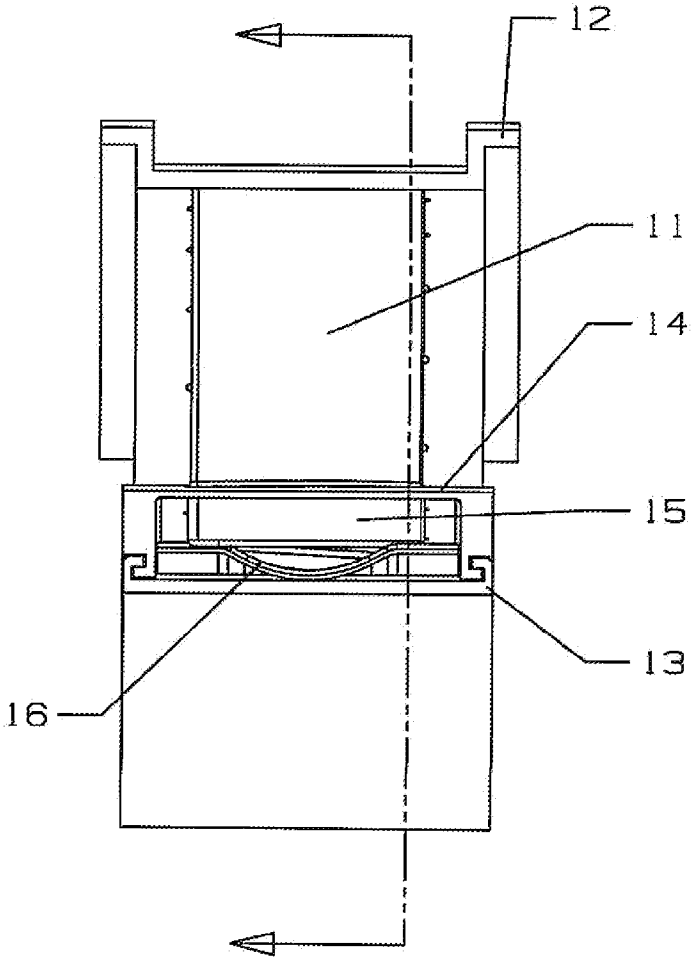
FIG. 2 shows a cross sectional view of a single vane in the stator assembly with the vibration damping horn and the damper spring arrangement of the present invention.

FIG. 2 shows a cross sectional view of the stator assembly and the vibration damping device of the present invention. The outer shroud 12 includes horns to secure the stator assembly to the engine casing. The airfoil 11 extends from the outer shroud to the inner shroud 14 with a vibrating damping horn 15 extending from the inner shroud and into a space formed with the seal 13. The damper spring 16 occupies the space and makes contact with both the vibration damping horn 15 and the seal 13. The damper spring 16 is bowed outward in the middle and has flat ends on the sides as seen in FIG. 2. The horns 15 extending from the airfoils 11 rub against the flat ends of the damper spring 16 while the inner surface of the seal 13 abuts against the bowed middle portion.

Figure 3:
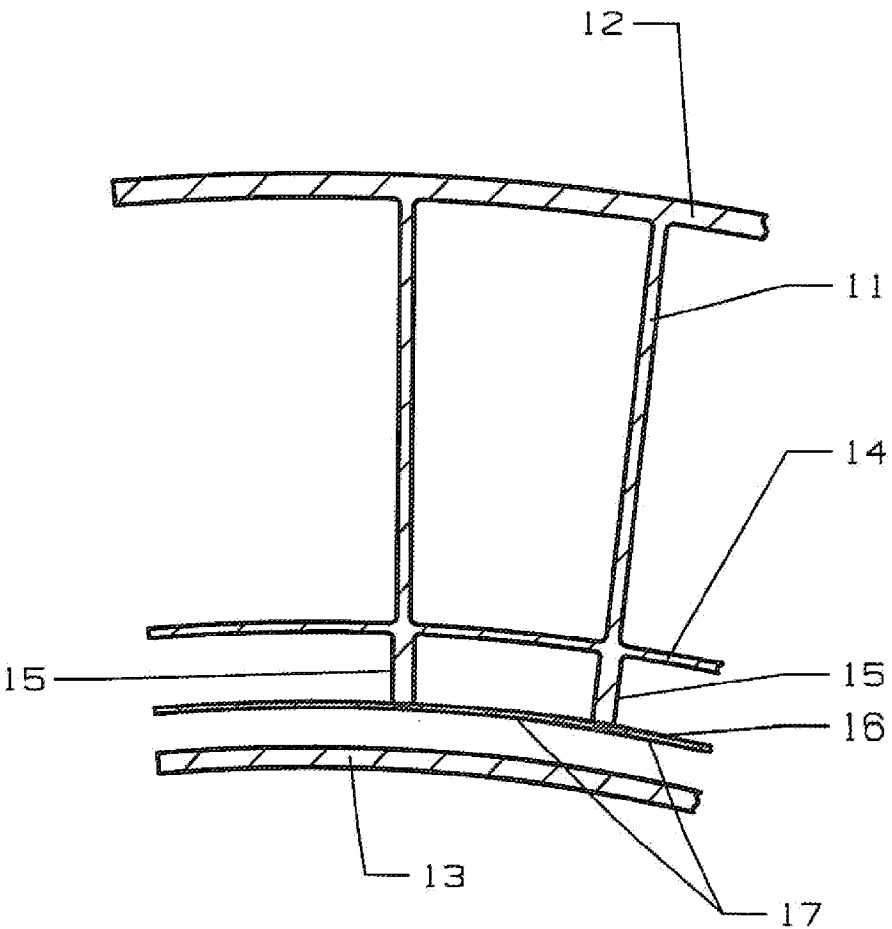
FIG. 3 shows a cross sectional view through line A-A of FIG. 2.

FIG. 3 shows a different view of the present invention through the section A-A in FIG. 2 in which the airfoil 11 includes thin walls that extend between the outer shroud 12 and the thin inner shroud 14. The outer shroud 12 is formed of thicker walls than the airfoil walls 11 and the thin inner shroud 14. The vibration damping horns 15 extend from the airfoil walls 11 in alignment, but are formed with thicker walls than the airfoil walls in order to be stiffer than the airfoil walls 11 as seen in FIG. 3. The damper spring 16 is wavy in cross sectional shape (as seen in FIG. 2) in order to make contact with the inner surface of the seal 13 and the ends of the vibration damping horns 15. Isolation relief cuts 17 are formed in the damper spring 16.

The airfoils in the present invention can be cast, brazed or machined integrally into the shroud. The shroud forms a flexible region around the airfoil such that a relatively low impedance connection is made to a vibration damping horn 15. This shroud is configured to have a higher stiffness in the forward and aft regions to prevent circular distortion of the stator assembly. Also, the shroud may be stiffer between airfoils to further isolate vibratory modes and to further enhance dimensional stability.

The vibration damping horns 15 are cast into or is a continuation of a brazed airfoil but with a thicker wall than the airfoil wall. The damper spring 16 includes a friction resisting coating to minimize wear against the rubbing of the horn tip against the damping spring 16 and to improve damping capability. The damper spring 16 includes the isolation relief cuts or slits for the same reason as in the cited prior art reference. As the stator assembly vibrates, the vibration damping horns will also vibrate and rub against the damper spring 16 to dampen the stator assembly. Because the vibration damping horns 15 are thick in relation to the airfoil walls 11 in order to prevent amplification of the vibratory modes. The vibration damping horn 15 is cast to or is a continuation of a brazed airfoil, and therefore the horn 15 passes the vibratory energy into the damper. The horn 15 is stiffer than the airfoil in order to prevent amplification of the vibration. The damper, either a friction damper or a viscous damping fluid or a visco-elastic material, functions to dissipate the vibratory energy.

Figure 4:
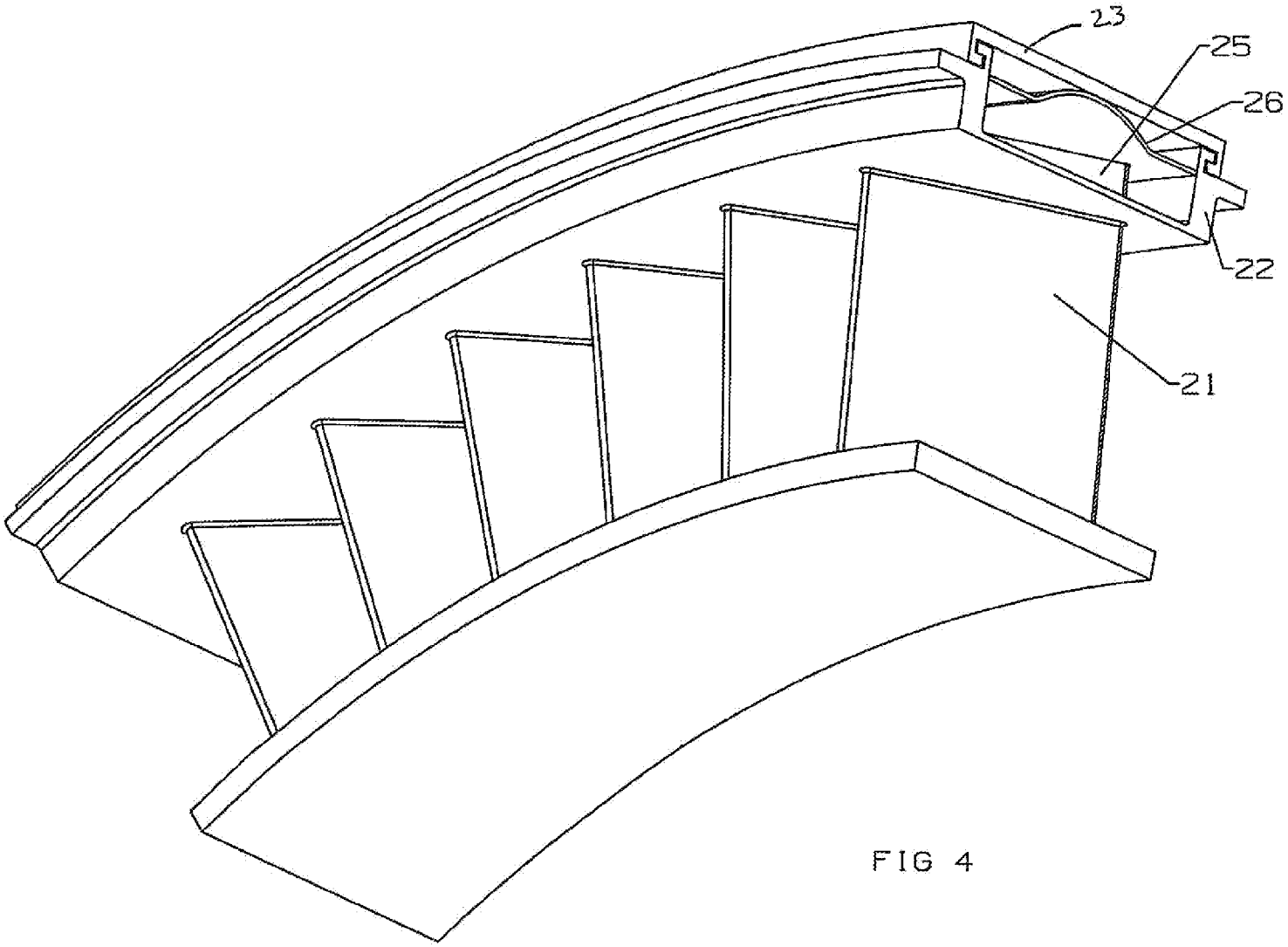
FIG. 4 shows a cross sectional view of a second embodiment of the present invention.
Figure 6:
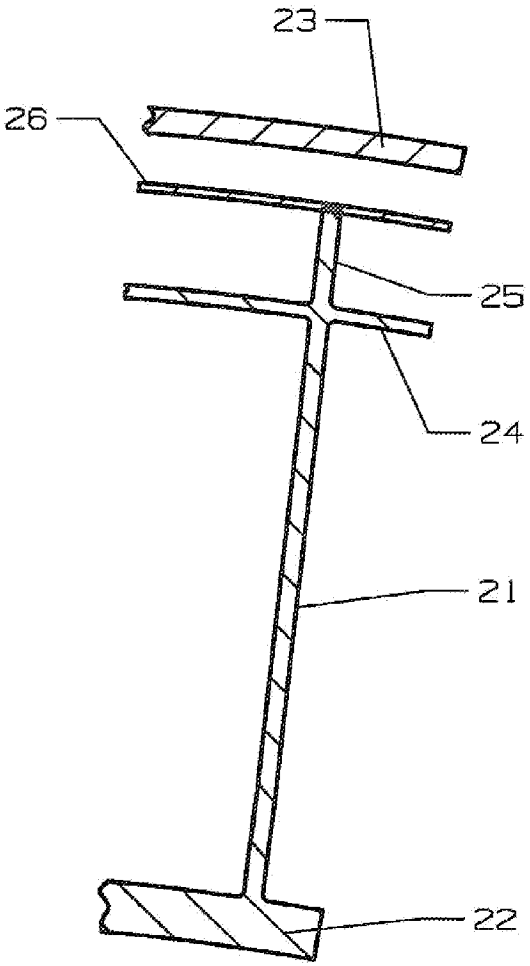
FIG. 6 shows a side view of the stator vane assembly through the line shown in FIG. 5.
Figure 5:
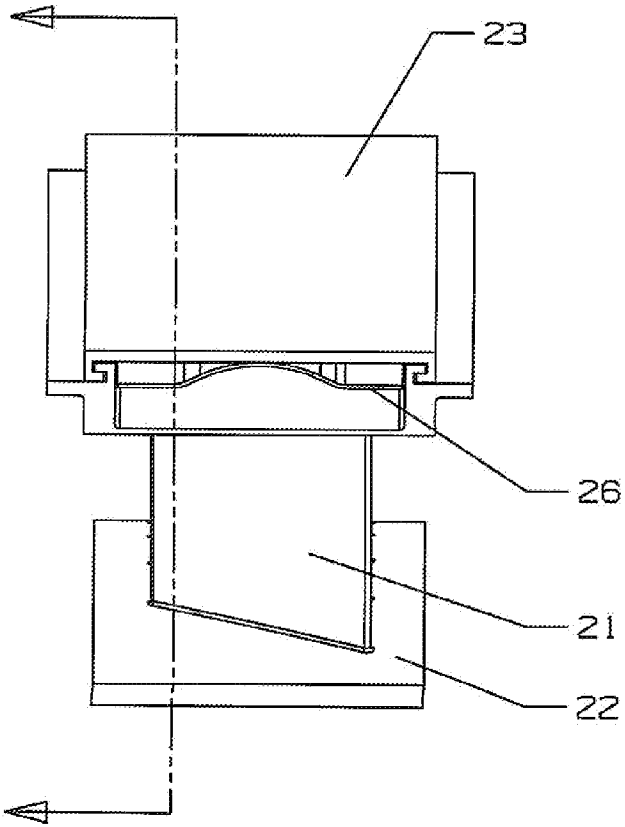
FIG. 5 shows a cross sectional view of a third embodiment of the present invention.

In a further embodiment as shown in FIGS. 4 through 6, the vibration damping horn 25 extends from the outer shroud section of the stator assembly and rubs against a damper spring 26 occupied in a space between the seal 23 inner surface. The airfoils 21 extend between the outer shroud 22 and an inner shroud that will form a seal with the rotor assembly of the turbo machine. The FIG. 4 embodiments is basically the FIG. 1 embodiment but flipped over so that the horns extend outward instead of inward. FIG. 6 shows a cross section from the side with the inner shroud 22 and the airfoil wall 21, and the horn 25 extending from the airfoil wall 21 but having a thicker width than the airfoil wall 21 as in the FIG. 1 embodiment. The inner shroud 24 forms a flow path through the airfoils 21. The damper spring 26 has the same shape as the damper spring in FIG. 4. FIG. 5 shows a schematic view of the stator assembly and the damper spring 26 of the second embodiment. The damper spring 26 also has a bowed middle portion and flat ends in which the horns rub against the flat ends while the inner surface of the shroud 23 abuts the bowed middle portion.

Figure 7:
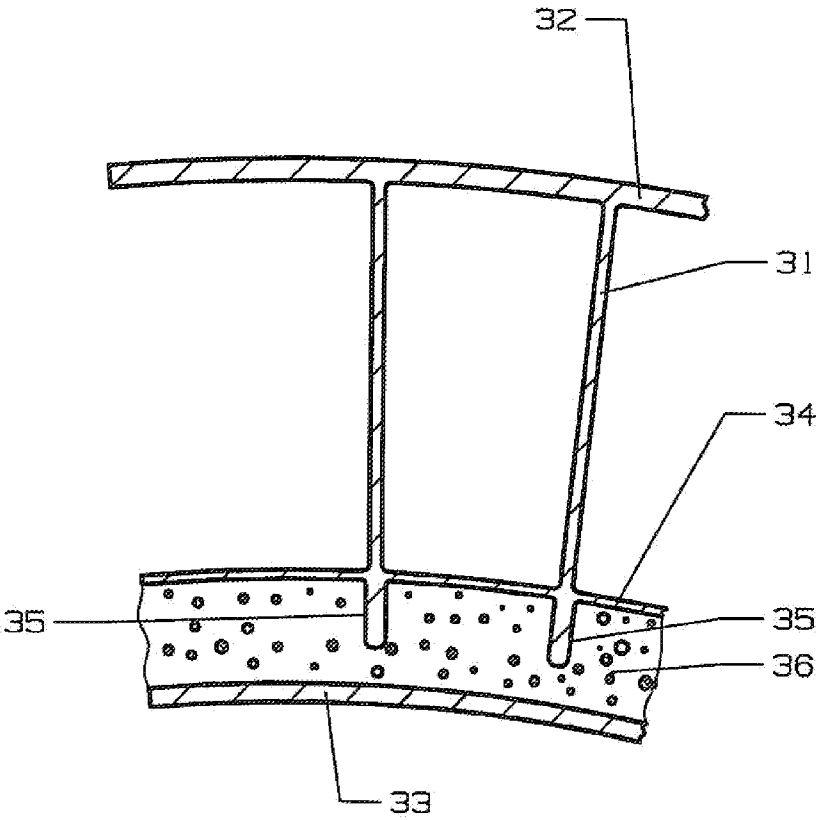
FIG. 7 shows another embodiment of the present invention in which a damping fluid is used to dampen the vibration occurring in the horns.

FIG. 7 shows an embodiment of the present invention in which a damping fluid is used to dampen the vibration occurring in the horns 35. the structure of the FIG. 7 embodiment is similar to the FIG. 1 embodiment except the damper spring is eliminated and the space formed between the inner shroud 34 and the inner surface of the seal 33 is filled with a viscous damping fluid or visco-elastic material 36 that will absorb the vibration of the horns 25. Also in this embodiment, the horns 35 have a thicker wall surface than the airfoils 31 to provide higher stiffness.

We claim the following:

1. A stator assembly for a turbo machine comprising:

a stator segment having an inner shroud and an outer shroud;

a plurality of airfoils extending between the inner shroud and the outer shroud; and a vibration damping horn extending from one of the shrouds and in line with the airfoil;

wherein the vibration damping horn having a higher stiffness than the airfoil; and the shroud that it extends from such that the vibration of the damping horn is promoted.

2. The stator assembly of claim 1, and further comprising: the stator segment is without relief slits formed between adjacent airfoils.

3. The stator assembly of claim 1, and further comprising: the vibration damping horn having a thickness greater than the thickness of the airfoils.

4. The stator assembly of claim 1, and further comprising: a damper spring in contact with the vibration damping horn.

5. The stator assembly of claim 4, and further comprising: the damper spring has a bowed middle portion and flat ends, where the flat ends rub against the vibration damping horn to provide the damping.

6. The stator assembly of claim 4, and further comprising: the damper spring is an annular shaped segment.

7. The stator assembly of claim 4, and further comprising: the damper spring is coated with a friction resisting coating on a side that rubs against the vibration damping horn.

8. The stator assembly of claim 1, and further comprising: the vibration damping horn extends from the inner shroud.

9. The stator assembly of claim 8, and further comprising:

a damper spring abuts against the vibration damping horn and an inner surface of a seal.

10. The stator assembly of claim 1, and further comprising:

the vibration damping horn extends from the outer shroud.

11. The stator assembly of claim 1, and further comprising:

the vibration damping horn extends into a space filled with a vibration damping fluid.

12. The stator assembly of claim 11, and further comprising:

the vibration damping fluid is a viscous damping fluid or visco-elastic material.

13. The stator assembly of claim 1, and further comprising:

each of the airfoils includes a vibration damping horn extending extend from the airfoil and shroud.

14. The stator assembly of claim 1, and further comprising:

the stator assembly is used in a compressor to guide flow into the rotor blades.

15. The stator assembly of claim 1, and further comprising:

the vibration damping horn having a higher stiffness than the shroud that it extends from in order to induce vibration of the damping horn.

16. A stator vane assembly for an axial flow compressor comprising:

a stator segment having an inner shroud and an outer shroud;

a plurality of airfoils extending between the inner shroud and the outer shroud;

a vibration damping horn extending from one of the shrouds and in line with the airfoil;

the vibration damping horn having a higher stiffness than the airfoil and the shroud that it extends from such that vibration of the damping horn is promoted; and, a damper spring in contact with the damper horn to absorb vibration.

17. The stator vane assembly of claim 16, and further comprising:

a plurality of airfoils each having a damping horn extending from the shroud; and, each of the damping horns is in contact with the damping spring.

18. The stator vane assembly of claim 16, and further comprising:

the damper spring has a wavy cross sectional shape with two ends and a middle section; and, the two ends make contact with one of the damping horn or a seal and the middle section makes contact with the other of the damping horn or the seal.

* * * * *